US005829215A

United States Patent [19]

Billing

[11] Patent Number: 5,829,215

[45] Date of Patent: Nov. 3, 1998

[54] MULTI-LAYER COMPOSITE PANEL AND METHOD OF MAKING SAME

[76] Inventor: Martyn Kenneth Billing, #18- 1060 Quayside Drive, New Westminster, British Columbia, Canada, V3M 6C1

[21] Appl. No.: 711,582

[22] Filed: Sep. 10, 1996

[51] Int. Cl.[6] ..... E04C 1/00

[52] U.S. Cl. ..... 52/309.4; 52/309.11; 428/159

[58] Field of Search ..... 52/309.4, 309.7, 52/309.8, 309.11, 309.16; 428/159

[56] References Cited

U.S. PATENT DOCUMENTS

| | | | |
|---|---|---|---|
| 3,043,730 | 7/1962 | Adie . | |
| 3,353,315 | 11/1967 | Barker | 52/309.11 X |
| 3,391,038 | 7/1968 | Whitesides . | |
| 4,351,870 | 9/1982 | English, Jr. | 52/309.7 X |
| 4,581,864 | 4/1986 | Shvakhman et al. | 52/309.4 X |
| 5,360,653 | 11/1994 | Ackley | 52/309.4 X |

*Primary Examiner*—Creighton Smith
*Attorney, Agent, or Firm*—Oyen Wiggs Green & Mutala

[57] ABSTRACT

The invention relates to a multi-layer composite panel and a method of making same. More particularly, the invention relates to a composite panel composed of a core of at least two layers of structural beam elements and a framework for holding the beam elements in place, with the beam elements and the core bound together and wrapped with fibre reinforcing fabric saturated with uncured resin, forming a unitary panel once the resin has cured.

20 Claims, 12 Drawing Sheets

MULTI-LAYER COMPOSITE PANEL AND METHOD OF MAKING SAME

FIELD OF THE INVENTION

The invention relates to a multi-layer composite panel and a method of making same. More particularly, the invention relates to a composite panel composed of a core of at least two layers of structural beam elements and a framework for holding the beam elements in place, with the beam elements and the core bound together and wrapped with fibre reinforcing fabric saturated with uncured resin, forming a unitary panel after the resin has cured.

BACKGROUND OF THE INVENTION

It is well known to use composite materials to design composite structures having high strength to weight ratios. Panels used to cover underground utility wells require strength to withstand static and dynamic loads from heavy vehicular traffic. Since some panels are installed in high traffic areas, the panels may be subjected to a high frequency of loading during the course of a panel's expected lifespan. Therefore, such panels must be able to withstand anticipated loads as set out in design load specifications. It is desirable to reduce the weight of panels to facilitate removing and reinstalling them for access to utility wells and the like. Accordingly, the need has arisen for panels having high strength to weight ratios to withstand specified design loads and to facilitate handling by maintenance crews.

Panels must span openings that are large enough to allow servicing, installation and removal of equipment such as transformers, junction boxes, pumps, screens, motors, and the like sized equipment. Traditionally, panels strong enough to carry heavy loads and span utility well openings have been made of metal or reinforced concrete. The panels must be rigid such that they do not deflect significantly when loaded. A disadvantage of metal or reinforced concrete panels is that they are heavy and difficult to remove without using mechanical hoists or levers.

It is known to use composite access panels with a core reinforcing layer in between upper and lower exterior skin layers. It is also well known to use an end-grain balsa wood core, where the wood fibres are oriented in the vertical direction. Balsa wood contributes to the structural strength of the composite material. However, compared to other possible core materials, large slabs of balsa wood are expensive. Accordingly, the need has arisen for substitute core materials that are less expensive than balsa wood.

It is known to fabricate a composite panel having a core material composed of a single layer of reinforcing walls and foam filler pieces in between upper and lower exterior skin layers. For example, U.S. Pat. No. 4,726,707, issued 23 Feb. 1988 to John R. Newton ("Newton") discloses a composite article comprising an upper and lower skin of fibre reinforced plastic material, spaced apart from one another with reinforcing walls of fibre reinforced plastic material extending between the upper and lower skins. U.S. Pat. No. 5,139,845, issued 18 Aug. 1992 to Beckerman et al., is another example of composite panel with a single layer of beams in a structural core.

However, a single layer of reinforcing walls biases the strength of the panel according to the orientation of the reinforcing walls. That is, a panel with a single layer of reinforcing walls will be stronger in one direction than another. A panel that is installed in a roadway may be subjected to loading from vehicular traffic travelling in any direction. A panel with more than one layer of reinforcing members can be designed to withstand maximum loading from more than one direction. Accordingly, the need has arisen for composite panels with more than one layer of beams where the beams in different layers can be aligned in different directions for greater bearing capacity and for greater capacity to withstand high frequency multi-directional loading.

Newton also discloses a preferred method of manufacturing composite panels using the Crenette Process. In this method the fibre reinforcing fabric is pre-formed with a thermosetting plastics material to render them coherent an d stiff but still malleable. By-passing this step will result in a more efficient manufacturing process because of the time saved by not having to do this step and because the fibre reinforcing fabric is more flexible and easier to handle if it has not been pre-formed. Accordingly, the need has arisen for a more efficient method of manufacturing composite panels which does not require use of the Crenette Process.

Traditional methods for injecting resin into a composite panel have relied on spillage of resin from venting ports to ensure that resin has saturated all areas on the panel. Several venting ports are normally used because the mould and panel are typically oriented in a horizontal position for ease of loading the composite elements into the mould. Adequate venting is important to make sure air pockets are not trapped in the composite structure. However, resin spilling out of the venting ports causes resin to be wasted and results in the spilt resin causing untidiness in the workplace. Accordingly, the need has arisen for a resin injecting method that ensures adequate venting while containing the resin and avoiding spillage which results in wastage and untidiness in the workplace.

SUMMARY OF THE INVENTION

The invention is a multi-layer composite panel and a method of making same. The panel has a multi-layer structural core, covered on its top, bottom and all of its sides by a fibre reinforced resin skin. The skin seals and protects the panel core from the outside environment. The skin forms a hard, durable, and rigid outer layer.

The panel core comprises a closed cell foam slab which is cut with a plurality of slots of various widths and orientations. The slots are arranged in a predetermined pattern for receiving structural members. The foam slab does not itself contribute to the structural strength of the core. However, the foam slab serves several non-structural functions.

First, the foam minimizes the amount of resin required. The foam acts as a filler so there are no void spaces between structural elements that would be unnecessarily filled with resin if the voids were left unfilled. Closed cell foam does not absorb liquids so the foam filler does not absorb any resin when resin is injected into the panel.

Another important function of the foam slab is to act as a framework for holding the panel core elements in place until all of the composite elements are bonded together by a curable resin. Friction between the structural elements and the side walls of slots in the foam slab hold the elements in place until the resin has been injected and given time to cure. The predetermined pattern of slots holds the structural elements in the desired positions and spacings until the resin has hardened.

Beams positioned in foam slab slots provide structural load carrying capacity. The beams span across the foam slab from one edge of the slab to another. The beams are arranged in at least two separate co-planar arrays forming at least two distinct layers in the panel core. The adjacent layers of beams define a horizontal plane between them. An advantage of using at least two separate beam arrays is that the beams can be oriented in more than one direction, such that the beams form a structural grid, enhancing the strength of the composite panel.

Vertical plate members positioned in slots in the foam slab cross the horizontal plane in between the co-planar arrays of beams. The vertical plate members are bonded to structural members on both sides of the horizontal plane, bonding the beam arrays together, thus preventing failure of the panel along the horizontal plane, increasing shear strength.

The beams and vertical plate members have a stressed skin construction, made by wrapping the structural elements with fibre reinforcing fabric and saturating the fabric with uncured liquid resin. This adds structural strength to these structural members once the resin cures into a solid. Since all of the beams and vertical plate members are covered by a layer of fabric reinforced resin these structural elements are bonded to one another and to the skin where they are in contact with one another. The vertical plate members extend from the interior surface of the skin layer that covers the top surface of the panel.

The stiffness of the panel and its resistance to deflection is improved by attaching rib stiffeners to the interior surface of the skin that covers the top surface of the panel. Rib stiffeners are vertically oriented structural members which can be constructed of fibre reinforced resin.

The curable resin can be any type of resin that cures into a hard, durable, solid. For example, the resin can be a polyester resin, an epoxy resin or a vinyl ester resin.

The method of making a multi-layer composite panel comprises the steps that are set out as follows.

First, the foam slab must be cut to size and shape. Recesses can be cut for hinge pins and bevelled edges can be trimmed using a guide and a fine wire. The foam slab is cut to a size slightly smaller than the size of the finished panel, to allow for the thickness of the skin layer which covers the structural core.

Next, the foam slab is cut with a plurality of slots and holes of different sizes and depths, arranged in a predetermined pattern, according to the structural strength requirements of the panel. An array of slots is cut into the bottom surface of the foam slab for receiving a plurality of beams in a lower structural layer. Another array of slots is cut into the top surface of the foam slab for receiving a plurality of beams in an upper structural layer. A plurality of slots is cut in the top surface of the foam slab for receiving vertical plate members and rib stiffeners.

The beams and vertical plate members wrapped with fibre reinforcing fabric are inserted into their respective slots. Fibre reinforcing fabric is also inserted into slots to make rib stiffeners.

Once the slots and holes in the foam slab are filled, the entire slab is wrapped with fibre reinforcing fabric and laid in a mould. The mould is closed, sealing the wrapped slab inside. Uncured resin is injected into the mould until the fibre reinforcing fabric is saturated and all of the structural elements are coated with resin. The sealed mould prevents the leakage or spillage of any resin where the two halves of the mould are joined. A single venting tube is used to let the air escape from the mould and to control the spillage of resin.

The mould is kept closed until the resin cures. Then the mould is opened and the unitary multi-layer composite panel is removed.

The advantages of the invention include its high strength to weight ratio, the high load carrying capacity of the grid arrangement of beams, the cost savings of producing panels according to the invention compared to traditional panels and methods, the efficiency of manufacturing panels without the need for pre-forming using methods like the Crenette Process, and the containment of resin during the resin injection and curing phases of manufacture, to avoid resin spillage.

BRIEF DESCRIPTION OF THE DRAWINGS

In the accompanying drawings which illustrate a preferred embodiment of the invention, but which should not be construed as restricting the spirit or scope of the invention in any way.

DETAILED DESCRIPTION OF THE PREFERRED EMBODIMENT

Figure 1:
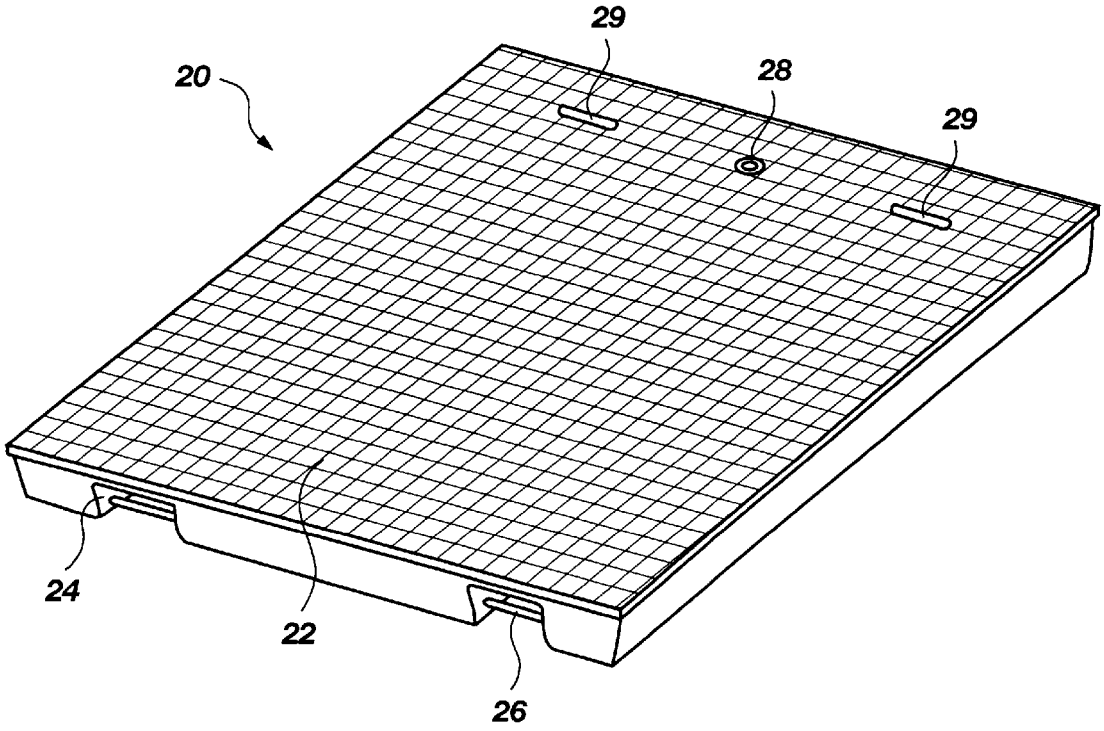
FIG. 1 is a perspective view of the panel.
Figure 2:
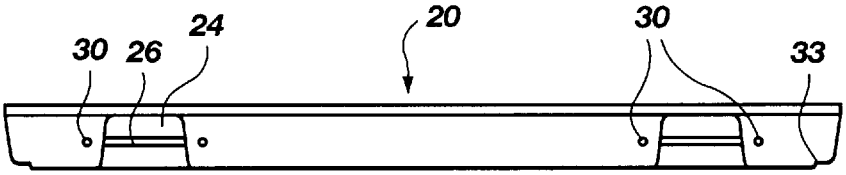
FIG. 2 is a front elevation of the panel.
Figure 3:
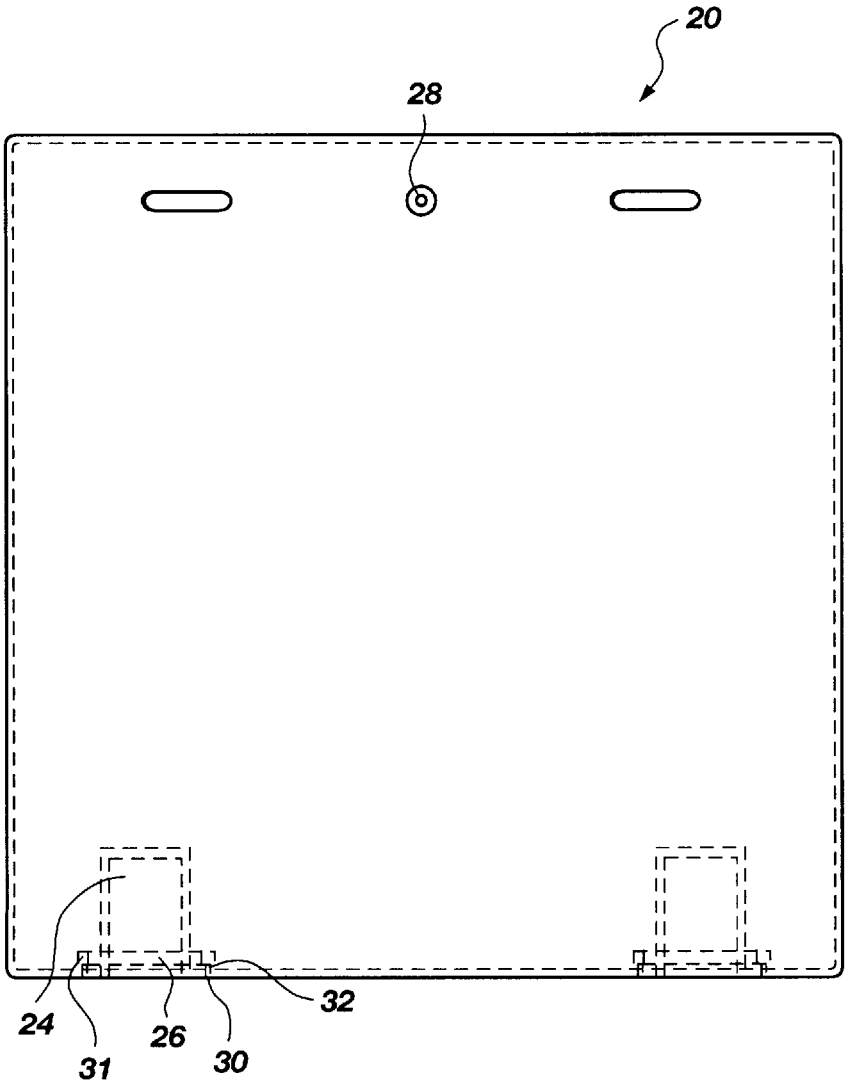
FIG. 3 is a plan view of the panel.

FIGS. 1 through 3 depict the finished composite panel (20). FIG. 1 is a perspective view which shows the textured anti-slip top surface (22) and the hinge assembly recesses (24) on the front elevation for the hinge pins (26) and clips. Towards the rear edge, there is a bolt hole (28) and holes and shallow recesses (29) for lift handles.

FIG. 2 is a front elevation of the panel (20), showing the hinge assembly recesses (24) and the hinge pins (26). Resin injection points (30) are located on the side of the panel (20) for injecting resin into the hinge pin hole cavities (31). The side walls are angled slightly such that the bottom of the panel is smaller than the top of the panel. On the two sides abutting the front elevation, the bottom edge has a shallow indent (33) for attachment of a metal strip. When more than one panel is used to cover a large opening, the crack between adjoining panels can be covered by a metal strip affixed to one of the panels. Metal plates are embedded in the panel (20) to which the metal strip is attached. Horizontal slots in the panel core are cut to receive the metal plates. The metal strip prevents objects from slipping through the crack between adjoining panels and into the utility well below.

FIG. 3 is a plan view of the panel (20). The hinge assembly recesses (24) are shown in dashed lines, as are the hinge pins (26) and the resin injection points (30) and resin canals (32). The hinge pin hole cavities (31) are filled with resin which is injected at the resin injection points (3) and conveyed through the resin canals (32).

Figure 4:
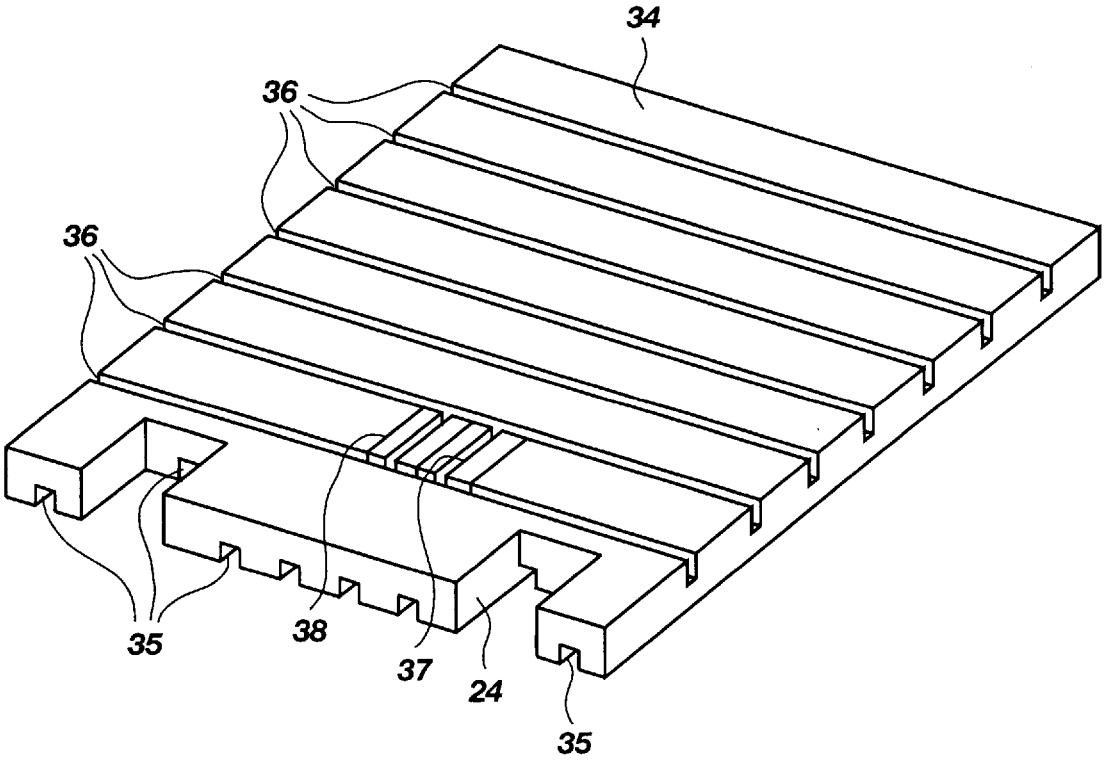
FIG. 4 is a perspective view of the foam slab.

FIG. 4 is a perspective view of the foam slab (34) with a number of slots cut for receiving beams, vertical plate members, fibre reinforcing fabric, plugs and metal reinforcing plates. More slots can be cut according to a predetermined pattern. The foam slab (34) acts as a framework for holding all of the structural elements in position until they are bonded together by the resin. Because the foam slab (34) holds the structural elements and fibre reinforcing fabric in position, there is no need to preform the fabric using traditional methods such as the Crenette Process. The foam slab (34) also fills the void spaces between the structural elements to minimize the amount of resin required to bond the composite elements together.

The fibre reinforcing fabric can be made from fibre glass, aramid fibre, or carbon fibre. The fabric can be either woven roving or mat (single randomly oriented strands).

The foam slab (34) depicted in FIG. 4 has been cut to size and shape. Two recesses (24) have been cut to accommodate hinge assemblies. Slots (35) have been cut in the bottom of the slab (34) to receive the lower array (42) of beams (40). Slots (36) have been cut in the top of the slab (34) to receive the upper array (44) of beams (40). Slots (37) have been cut in the top of slab (34) for receiving vertical plate members (50). Slots (38) have been cut in the top of the slab for the insertion of rib stiffeners (54).

The foam slab (34) depicted in FIG. 4 is a single piece of foam that has been cut into an intricate shape. Low density foam slabs, for example, are used because they are less expensive than stronger higher density foam materials. However, a problem with using low density foam is that it is structurally weak. The Applicant has found that it is important to develop a pattern for the complex structural framework such as that shown in FIG. 6 which leaves the foam slab (34) with sufficient strength to act a carrier that can be handled once it is packed with structural elements.

Figure 5:
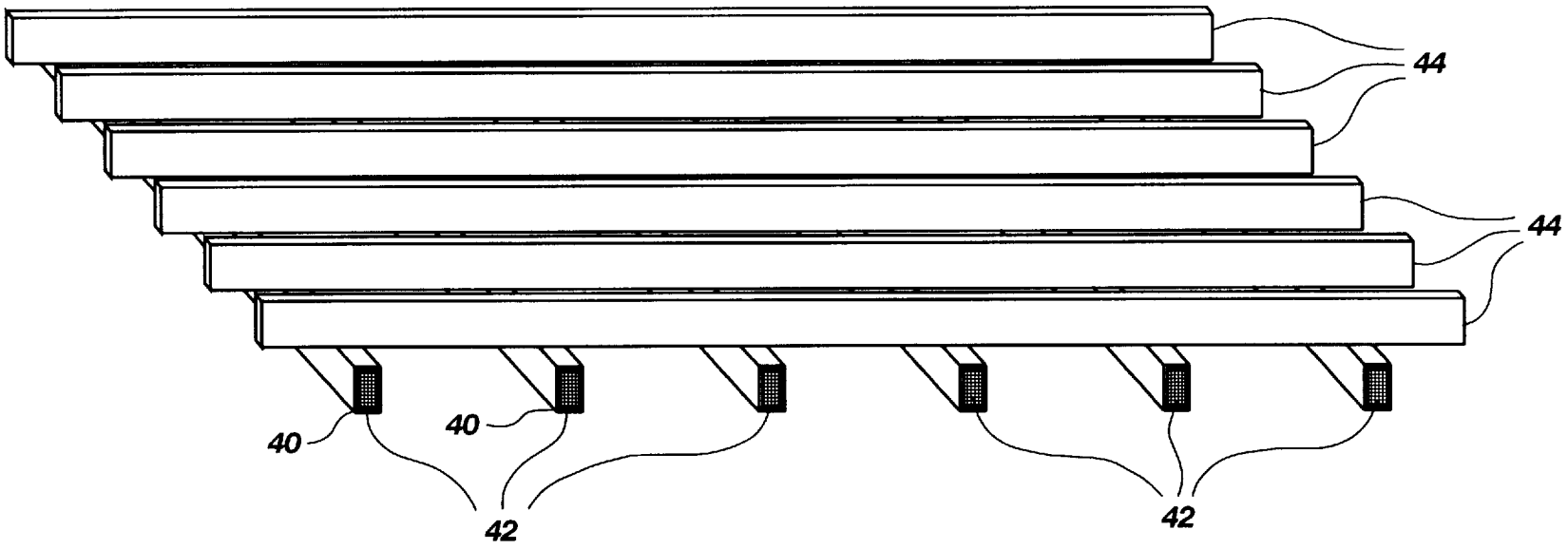
FIG. 5 is a perspective view of the upper and lower arrays of beams.

FIG. 5 is a perspective view of the upper array (44) and lower array (42) of beams (40) showing the structural grid that is packed inside the foam slab (34). In the preferred embodiment, beams (40) in the upper array (44) are bonded to the beams (40) in the lower array (42) where the upper array (44) rests upon and the lower array (42).

Figure 6:
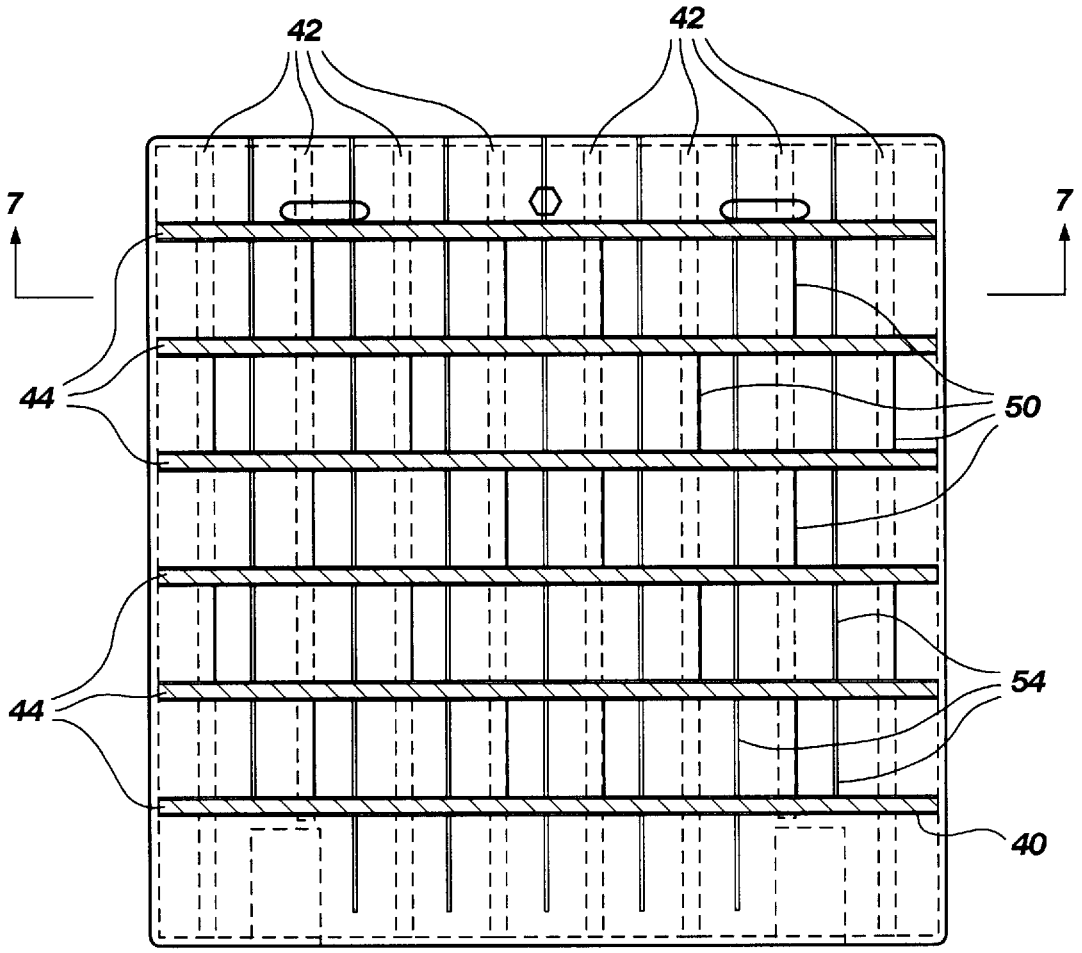
FIG. 6 is a horizontal section view of the panel taken through the upper structural core layer of the panel.

FIG. 6 is a plan view of the panel (20) depicting a section cut through the upper array (44). The structural core elements are shown in dashed and cross-hatched lines. The beams (40) in the upper array (44) cross the panel (20) from left to right and are cross-hatched. The beams (40) in the lower array (42) are shown in dashed lines crossing the panel (20) from top to bottom.

A problem with making a structure with two separate structural co-planar layers is that this creates a shear plane along the horizontal plane which interfaces the adjacent layers. The Applicant has solved this problem by bonding the lower array (42) to the upper array (44) by several means. Fibre reinforced resin bonds the layers together at the points where they contact one another. Vertical plate members (50) help to unify the structural elements by bonding to the beams (40) in both arrays (42) and (44) and to the top skin layer (51). The vertical plate members (50) have large contact surfaces with the beams (40) and with the top skin layer (51) and the resin bonds these structural elements together at these contact surfaces.

FIG. 6 also shows the vertical plate members (50) which are perpendicular to and span between the beams (40) in the upper array (44). The vertical plate members (50) are shown as the cross-hatched members positioned above beams in the lower array (42). A fibre reinforced resin member which extends from the vertical plate (50) overlaps a side of the underlying beam (40) in the lower array (42). These overlapping surfaces create strong bonds between the vertical plates (50) and the beams (40) in the lower array (42). The resin also binds the sides of the vertical beam members (50) to the beams (40) in the upper array (44).

FIG. 6 also shows the rib stiffeners (54) which are perpendicular to the beams (40) in the upper array (44). Rib stiffeners (54) attached to the upper skin layer (51) increase the resistance of the panel (20) to deflection by stiffening the top skin layer (51). The rib stiffeners (54) are rigid members which protrude from the underside of the top skin layer (51) of the panel (20). The beams (40) in the upper array (44) are also bonded to the top skin layer (51) and serve as stiffeners in the direction perpendicular to the rib stiffeners (54) and the vertical plate members (50).

Figure 7:
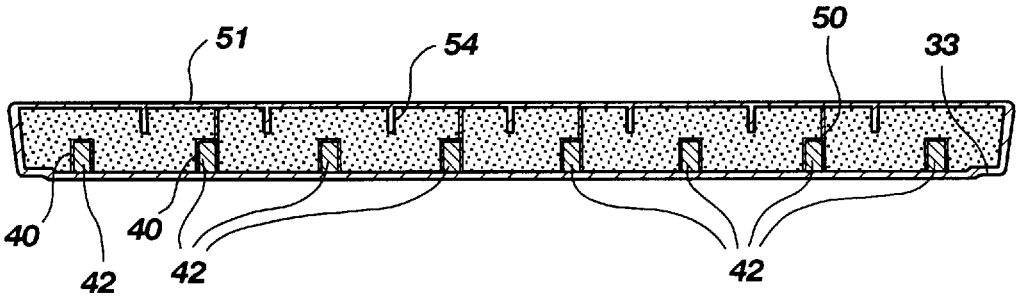
FIG. 7 is a vertical section view of the panel.

FIG. 7 is a section view of the panel showing the vertical plate members (50) positioned above the lower beams (40) at predetermined intervals. Rib stiffeners (54) extend downwards from the top skin layer (51), perpendicular to the beams (40) in the upper array (44), which are perpendicular to the beams (40) in the lower array (42).

Figure 8A:
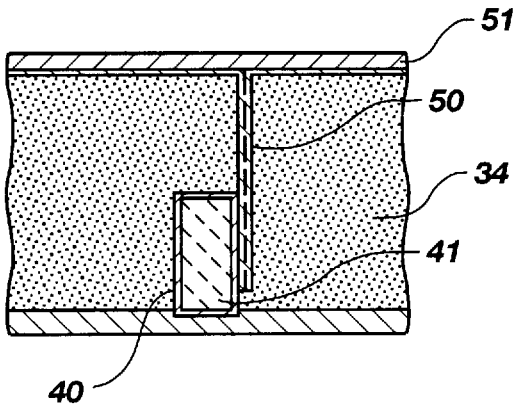
FIG. 8 is a section detail of three types of vertical plate elements.

FIG. 8 is a section detail of three types of vertical plate members (50). The section marked FIG. 8A shows a plate member (50) that is formed from fibre reinforcing fabric saturated with resin. Once the resin cures, this plate member (50) becomes a rigid panel which is bonded to the top skin layer (51) and to the beam (40) in the lower array (42). The vertical plate member (50) is bonded to the fibre reinforced resin skin on the lower beam (40) where the side of the vertical plate member (50) contacts the beam (40).

Figure 8B:
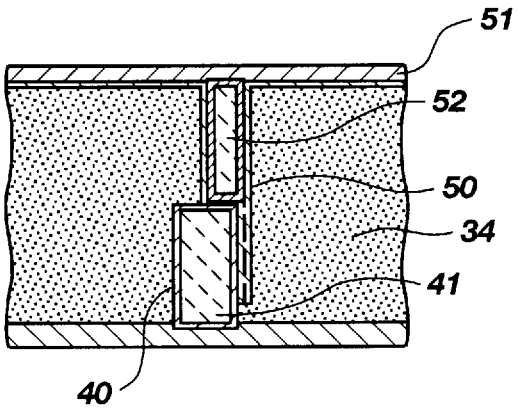
Figure 8C:
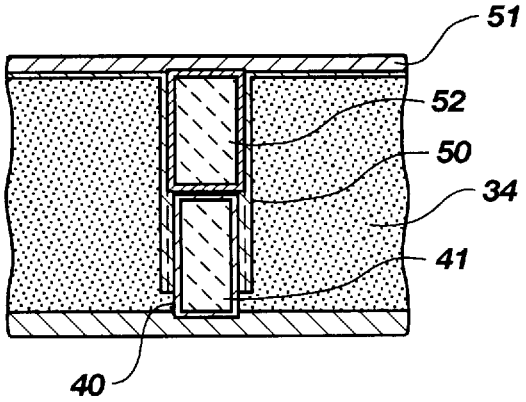

The sections marked FIG. 8B and FIG. 8C show vertical plate members (50) that consist of fibre reinforced resin and a filler piece (52). The filler piece (52) strengthens the vertical plate member (50) by adding stiffness and more contact area with the top skin layer (51) and the beam (40) in the lower array (42). In FIG. 8B the thickness of the filler piece (52) is less than the thickness of the beam (40) and a fibre reinforced member overlaps the beam (40) on one side. In FIG. 8C, the thickness of the filler piece (52) is greater than the thickness of the beam (40) and fibre reinforced resin members overlap the beam (40) on both sides.

Figure 9:
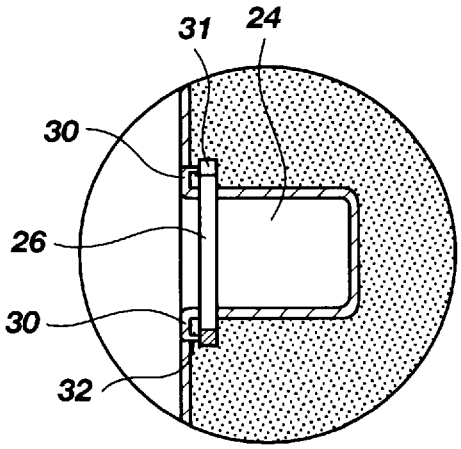
FIG. 9 is a detail of a hinge pin installed in the panel.

FIG. 9 is a detail of a hinge pin (26) installed in the panel (20). The hinge-pin-holes are drilled deep enough to allow the pin (26) to be angled into one of the hinge-pin-holes and then slid back out until it is inserted in the opposite hinge-pin-hole. To prevent the hinge pin (26) from sliding out, the end cavities (31) in the hinge-pin-holes are filled with a resin, such as a silicon resin. The resin is injected at the resin injection points (30) and through the resin canal (32) which conveys the resin to the cavity (31). Once the cavities (31) at both ends of the hinge pin (26) are filled with resin, the hinge pin (26) can not slide out and the foam slab (34) in the panel core is protected and sealed against the outside environment.

Figure 10:
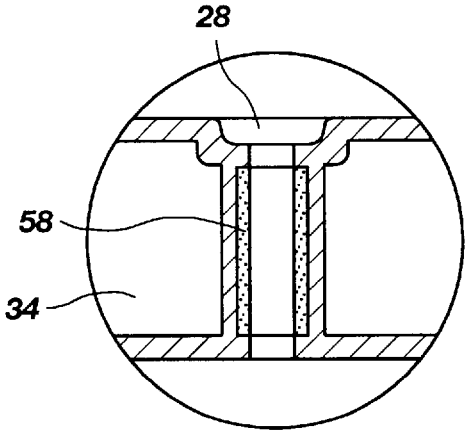
FIG. 10 is a section view detail of a bolt hole.

FIG. 10 is a section view detail of a bolt hole (28) showing a fibre reinforced resin sleeve (58) with the foam hole-core drilled out. The bolt hole can also be fitted with a metal sleeve for additional reinforcement and protection.

The method of manufacturing the panel (20) begins with trimming the foam slab (34) to the correct size and shape, allowing for the thickness of fibre reinforced layers which will cover all outer surfaces of the foam slab (34), forming a protective skin layer for the panel (20). The sides of the slab (34) are trimmed so the sides angle slightly inwards towards the panel bottom. A fine metal wire can be used to cut the sides of the slab (34). Straight and rigid guide pieces can be used to guide the wire along the edges of the slab (34).

At this stage, the foam slab (34) is cut to accommodate various features such as hinge pins, bolt holes, and lift handles holes and recesses. For example, if the panel (20) is to be fitted with a hinge pin (26), a hinge assembly recess (24) is cut into the foam slab (34) for each hinge pin (26). Bolt holes (28) and holes for lift handles (29) are cut using a rotating fly-cutter. The fly-cutter cuts a hole in the foam slab (34) while preserving a matching hole-core plug which has a smaller diameter than the hole produced. The plug is wrapped in fibre reinforcing fabric until it can be snugly reinserted into the matching hole in the slab (34).

Once the foam slab (34) is cut to the desired shape and size, and any holes are cut and filled, the next step is to cut straight slots in the upper and lower surfaces of the foam slab (34) to accommodate structural elements. Beam slots are cut from one edge of the slab to the other. The bottom surface of the foam slab is cut to form an array of slots (42) for receiving beams in a predetermined pattern. If the panel (20) is designed with hinges, in the preferred embodiment, the beams (40) in the lower array (42) span from the edge of the slab (34) with the hinge assembly recesses (24) to the opposite edge.

P The top surface of the foam slab (34) is cut to form an upper array of slots (44) for receiving beams in a predetermined pattern. In the preferred embodiment, the beam slots in each array are cut at uniform spacings and to uniform dimensions.

In the preferred embodiment, there are two layers of beams in the structural core. The beams (40) in each layer are arranged in an array with the beams inserted an equal distance into the foam slab (34) and with the beams (40) parallel to one another. The beams (40) in the upper array (44) are perpendicular to the beams (40) in the lower array (42). The depth of the beams (40) is equal one half of the thickness of the foam slab (34). The beam layers are distinct but touch each other at the points where the upper beam array (44) crosses over the lower beam array (42).

In the preferred embodiment, the upper and lower beams (40) have the same dimensions. Stress skinned beams (40) are made by taking a beam core-element (41) and wrapping it with a fibre reinforced resin skin. Making all of the beams with the same dimensions increases production efficiency because then the beam core-elements (41) can all be produced at the same time, using the same machines, without re-setting the machines for the width of the beams (40) being cut.

Figure 11:
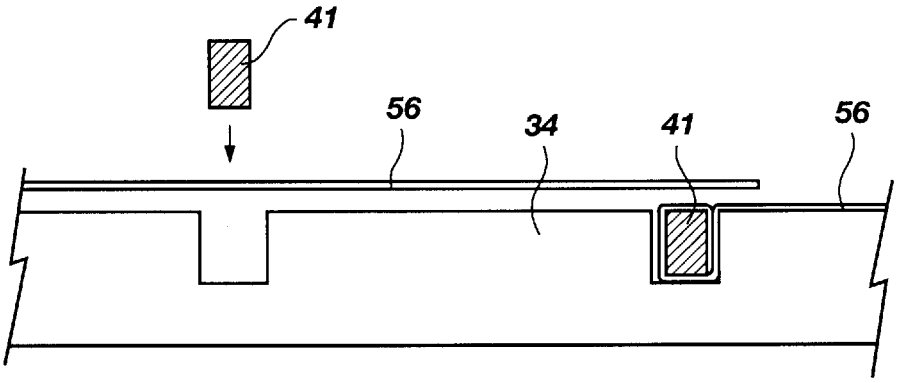
FIGS. 11 through 13 depict a sequence of steps whereby the beam core-element is wrapped with fibre rein-forcing fabric.
Figure 12:
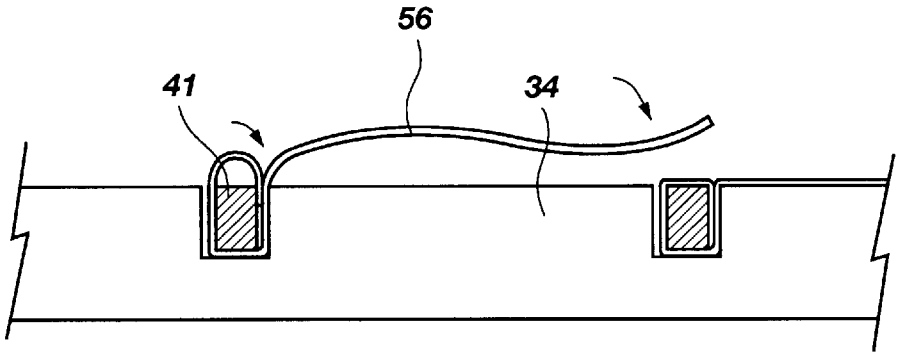
Figure 13:
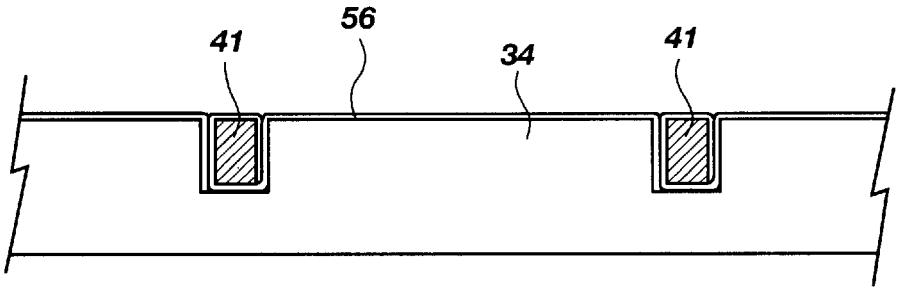

FIGS. 11 through 13 depict a sequence of steps whereby a beam core-element (41) is wrapped with fibre reinforcing fabric. A strip of fibre reinforcing fabric (56) with a length equal to the length of the beam core-element (41) and with a width greater than the perimeter of a beam core element (41) section is laid over an empty beam slot. The beam core-element (41) is pushed into the beam slot thereby also pushing in the fabric (56) and lining the beam slot with fibre reinforcing fabric (56). Two edges of the fabric (56) extend from the slot on either side of the beam core element (41). One fabric edge is tucked into the same slot on the other side of the beam core-element (41), thus covering the top of the beam core-element (41). The other fabric edge is tucked into the side of an adjacent parallel beam slot.

The beam core-elements (41) can be made from solid wood, wood by-product composites, or pultruded plastic. The wood or wood by-product beam core-elements (41) can be made by taking a sheet of the material that has a thickness that is equal to the desired depth of the beam core-element (41). The sheet is cut to a width that is equal to the width of the foam slab (34), establishing the length of the beam core-elements (41). Beam core-elements (41) of equal depth are made by cutting strips of equal thickness from the sheet. The beam core-elements (41) are uniform in depth and have a length equal to the width of the slab (34).

A similar procedure is used to install the vertical plate members (50) and the rib stiffeners (54). A strip of fibre reinforcing fabric having a width equal to the distance between adjacent beams in the upper array (44) is laid over the slots in the space between two beams (40). A continuous roll of fabric can be used, which is cut after it has been inserted into the slots.

A thin flat tool, such as a putty knife can be used to push the fabric strip into the narrow slots which span between the two beams (40). The slots above beams in the lower array (42) are open to the bottom of the slab (34) and the fabric is inserted almost the full depth of the slab (34). If the panel has been designed with filler pieces (52), the slots are wider to accommodate the filler pieces (52). The filler pieces (52) are inserted after the fabric has been inserted. The filler pieces (52) can be made from the same material as the beam core-elements (41).

Figure 14:
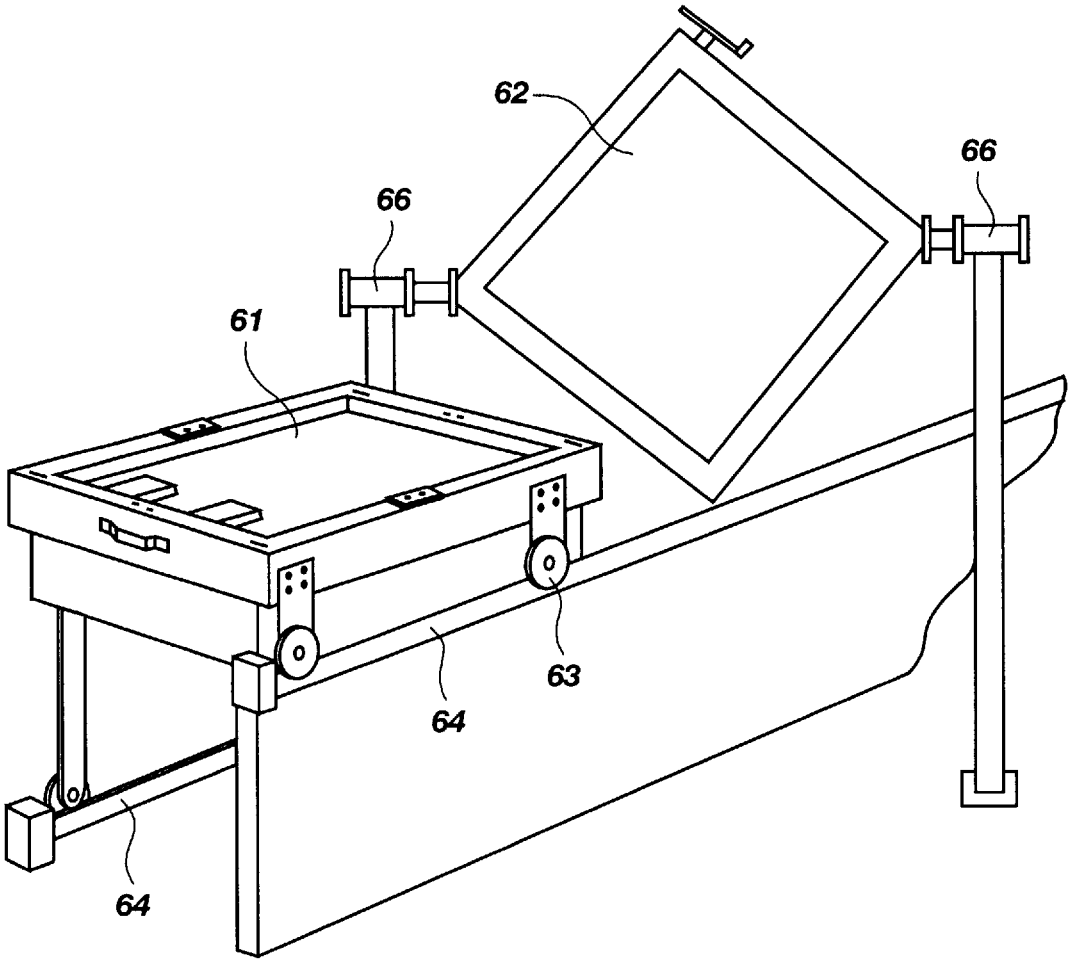
FIG. 14 is a perspective view of the open mould.

Once all the slots in the foam slab (34) are filled with structural elements, it is completely packed. The packed foam slab (34) is then wrapped on all exterior surfaces with at least one layer of fibre reinforcing fabric. Then the packed and wrapped slab (34) is deposited in a resin injection mould (60). FIG. 14 is a perspective view of the open mould (60). The mould (60) has a receiving tray (61) and a lid (62). The receiving tray (61) is mounted on a carriage with rollers (63) which allows the tray (61) to be rolled to one side of the lid (62). The lid is supported by pin joints (66) at two diagonally opposing corners which allow the lid (62) to be swung from a horizontal orientation to a vertical orientation. In FIG. 14, the receiving tray (61) is horizontally oriented and rolled to one side of the lid (62) which is shown vertically oriented.

Figure 15:
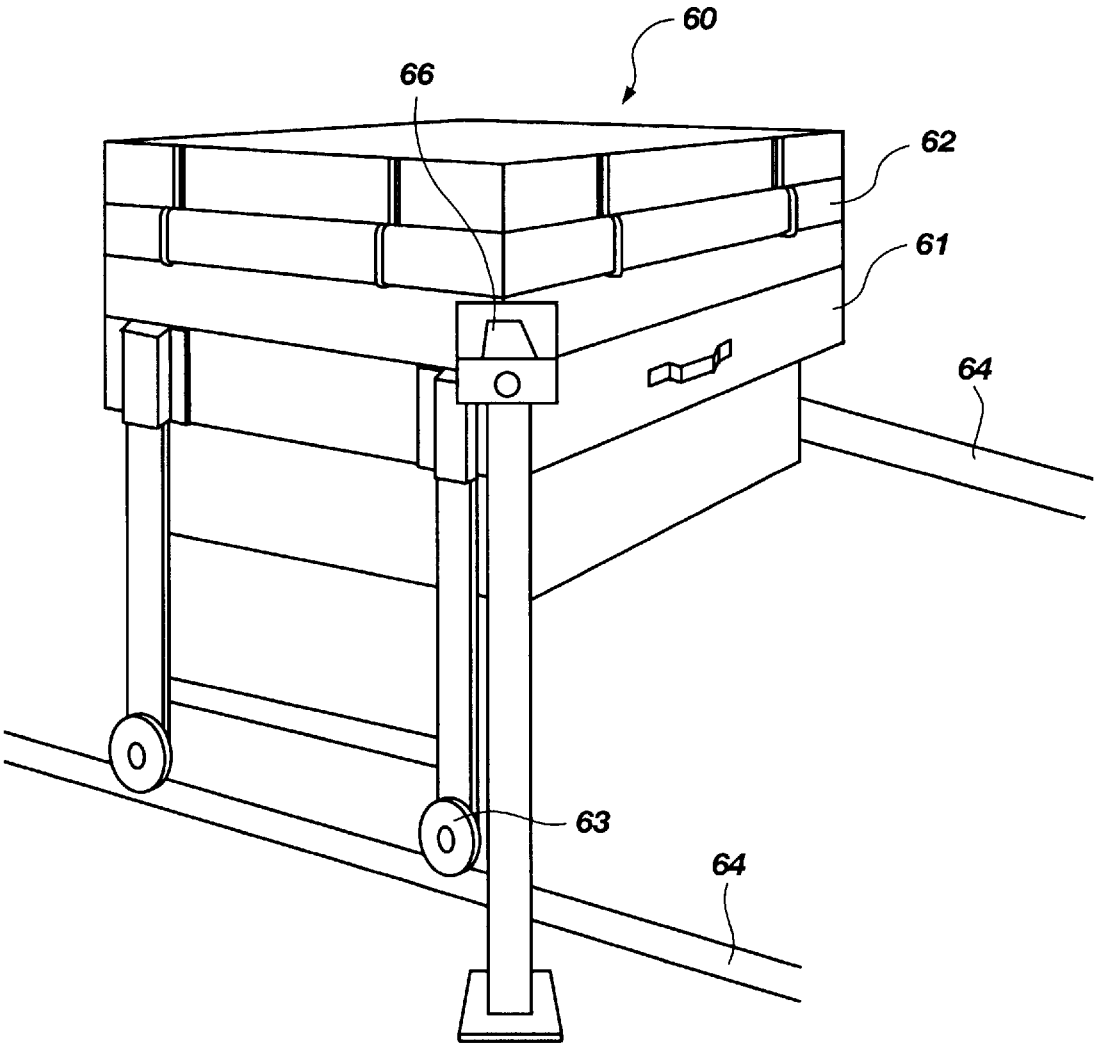
FIG. 15 is a perspective view of the closed mould in the horizontal orientation.

The receiving tray (61) is loaded in the horizontal position by depositing the packed and wrapped slab (34) into the tray (61). Once the slab (34) is deposited in the tray (61), the lid is swung to the horizontal position and the tray (61) is rolled directly below the lid (62). The mould is sealed by lifting the tray (61) from the carriage until it is in contact with the lid 962). The lid (62) and the tray (61) are clamped together to complete the seal FIG. 15 is a perspective view of the mould (60) in the horizontal orientation with the tray (61) directly below the lid (62).

The sealed mould (60) is then swung into a vertical orientation for injection of the resin. This is an improvement over injecting the resin with the slab (34) oriented horizontally. If the slab (34) were horizontal when injected with resin, because of the planar shape, the resin would be flowing mostly in the horizontal plane. This would require several venting tubes to make sure the panel was fully saturated at all of the panel (20) extremities. With a horizontally oriented slab there is also a greater danger of air bubbles being trapped inside the mould (60) preventing the resin from saturating all of the fibre reinforcing fabric.

Figure 16:
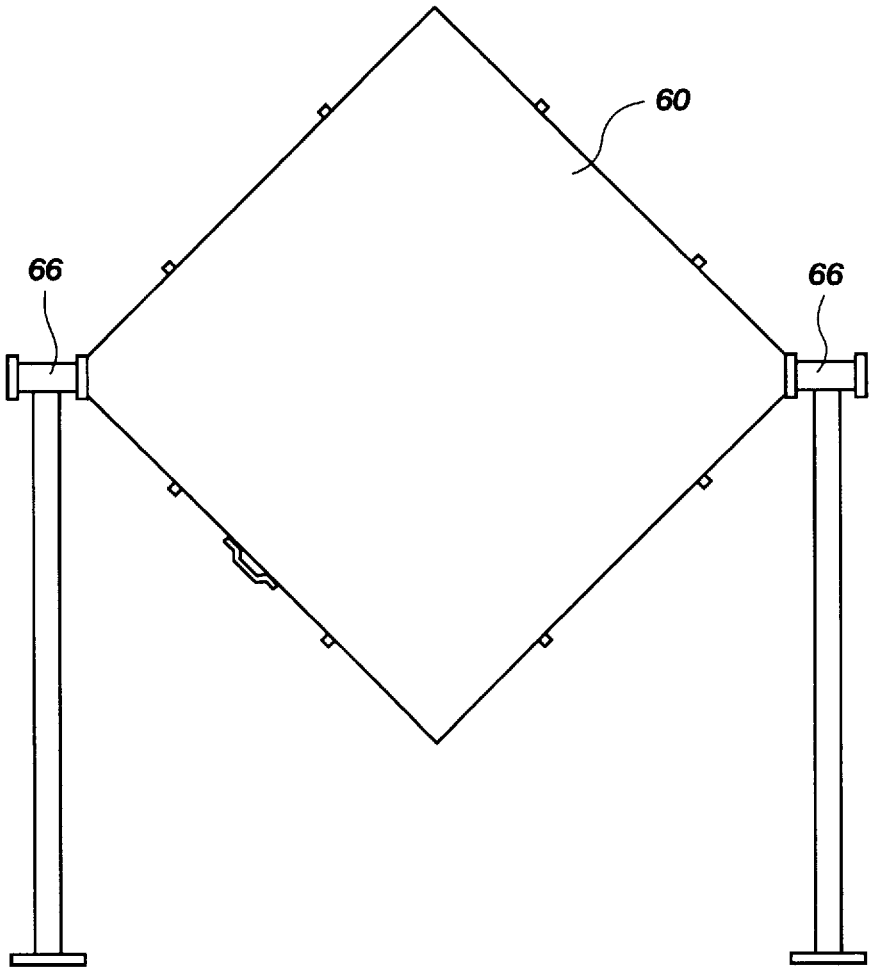
FIG. 16 is an elevation view of the closed mould in the vertical orientation.

In the preferred embodiment, the mould (60) is vertically oriented as shown in FIG. 16 and the resin is injected at the bottom and vented at the top. In this orientation air is less likely to be trapped since the venting tube is at the top of the mould (60) and the resin is injected from the bottom of the mould (60). The Applicant has found that the saturation of the panel (20) is optimized if the level of the resin in the mould (60) rises at a rate that approximates the capillary action of the resin being absorbed by the reinforcing fibres. With the mould (60) mounted vertically, only one venting tube is needed at the highest point of the mould (60).

The mould (60) is oriented such that the beams (40) in the panel (20) are oriented at a 45 or 135 degree angle from the horizontal. This facilitates the upward flow of the resin and the saturation of the reinforcing fibre. If the beams (40) were oriented in the horizontal and vertical directions, some of the resin would be forced to flow in the horizontal direction while some resin would be flowing upwards along the vertical beams (40). With the beams (40) oriented at 45 and 135 degrees, the resin is always being channelled upwards and there is less likelihood of forming trapped air pockets. Since the resin must flow upwards through the mould (60), a pump is used to provide the necessary pressure.

The mould (60) is kept in the vertical position until the panel (20) is saturated with resin and the resin has cured. To optimize the curing process the resin can be pre-heated to an optimal curing temperature before being injected into the mould (60). The Applicant has found that a temperature of between 90 and 150 degrees fahrenheit is optimal. The Applicant has found that curing is assisted if the mould is also heated to the same temperature.

The resin is mixed with a catalyst just before it is heated and injected into the mould (60). The catalyzed resin can be heated using a heat exchanger. The catalyst causes the resin to cure.

The strength of the composite panel (20) can be varied by adjusting the quantity of beams (40) and vertical plate members (50). The orientation of vertical plate members (50) also influences the strength of the panel (20) in a given direction.

The composite panel (20) is designed to be supported by its edges which rest upon a narrow ledge around the perimeter of the utility well opening. Where a single panel (20) is used to cover an opening, the panel (20) is supported on all four edges by the ledge around the perimeter of the hole.

A composite panel (20) can also be installed in combination with other composite panels to cover an opening that is larger than a single panel. Where more than three panels are installed side by side in a linear arrangement, the end panels are supported by three edges and the middle panel is only supported by two edges, since the middle panel is not supported by the two edges that adjoin the end panels. The middle panel is subjected to the worst case support arrangement for which the panels are designed. The middle panel is designed to support the maximum design load conditions while being supported only from the edge with the hinges and the opposite edge.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A multi-layer composite panel comprising:

a closed cell foam slab provided with a plurality of slots arranged in a predetermined pattern, and having an upper surface;

a plurality of beams positioned in a first plurality of said slots, arranged in at least two separate arrays such that there is a top beam layer and a bottom beam layer, wherein each array of beams is in a distinct layer, with adjacent layers defining a horizontal plane between them;

a plurality of vertical plate members position in a second plurality of said slots wherein said vertical plate members pass vertically through said horizontal plane;

a plurality of fibre reinforcing fabric pieces wrapped around said beams, said vertical plates, and lining said slots;

a fibre reinforcing fabric sheet wrapped around said composite panel; and a curable liquid resin which saturates said fibre reinforcing fabric and coats said beams, said vertical plates, and said foam slab, wherein said cured resin binds said composite panel into a solid unitary structure with said resin impregnated fabric sheet becoming a fibre reinforced skin covering said panel, and having an interior surface.

2. The multi-layer composite panel of claim 1, wherein said beams in adjacent layers touch at points where said beams intersect.

3. The multi-layer composite panel of claim 2, wherein said beams in each layer are parallel to one another.

4. The multi-layer composite panel of claim 3, wherein said beams in adjacent co-planar layers are oriented perpendicular to each other.

5. The multi-layer composite panel of claim 1, wherein said vertical plate members have a rigid composite structure, comprising resin saturated fibre reinforcing fabric and filler pieces wrapped in said fabric.

6. The multi-layer composite panel of claim 5 wherein said vertical plate members are attached to the skin and extend into vertical slots in the upper surface of said foam slab.

7. The multi-layer composite panel of claim 6 wherein said vertical plate members are oriented perpendicularly to said beams in said top beam layer.

8. The multi-layer composite panel of claim 7 where said vertical plate members are aligned with and directly above said beams in said bottom layer and said fibre reinforcing fabric comprising part of said vertical plate members extends vertically downwards from the upper surface of said slab and overlaps said beam in said bottom beam layer.

9. The multi-layer composite panel of claim 8 wherein said filler pieces in said vertical elements are made from the same material as said beams.

10. The multi-layer composite panel of claim 9 further comprising a plurality of rib stiffeners which extend vertically from the upper surface of said slab into a third plurality of said slots, composed of resin saturated fibre reinforcing fabric, which is bonded by the resin to the interior surface of said skin.

11. The multi-layer composite panel of claim 1 further comprising vertical holes lined with said resin and said fibre reinforcing fabric for receiving a bolt.

12. The multi-layer composite panel of claim 11 further comprising a hinge and a recess for providing a lift handle.

13. The multi-layer composite panel of claim 12 further comprising a vertical hole lined with resin and fibre reinforcing fabric for receiving fastening means.

14. The multi-layer composite panel of claim 13 wherein said hinge is attached to said panel inside a recess is said panel by a horizontal hinge pin anchored in horizontal holes in side walls of said recess, wherein said horizontal holes are lined with said resin and said fibre reinforcing fabric.

15. The multi-layer composite panel of claim 1 further comprising metal reinforcing plates positioned in horizontal slots in said foam slab.

16. The multi-layer composite panel of claim 1, further comprising a thin metal strip attached to a lower edge of said panel and extending horizontally to cover a gap between two of said composite panels which are installed side-by-side.

17. The multi-layer composite panel as claimed in claim 1 wherein said plurality of beams comprise beams made from a wood composite.

18. The multi-layer composite panel as claimed in claim 1, wherein said plurality of beams comprises beams made from solid wood.

19. The multi-layer composite panel as claimed in claim 1, wherein said plurality of beams comprise beams which are pultruded composite members.

20. The multi-layer composite panel as claimed in claim 1, further comprising a textured top surface having anti-skid properties.

* * * * *